US008245752B2

(12) United States Patent
Lingier et al.

(10) Patent No.: US 8,245,752 B2
(45) Date of Patent: Aug. 21, 2012

(54) APPARATUS AND METHODS FOR DISPENSING ADHESIVE TO LABELS

(75) Inventors: Eric Lingier, Straelen (DE); Reinhard Rettig, Gevelsberg (DE)

(73) Assignee: Nordson Corporation, Westlake, OH (US)

( * ) Notice: Subject to any disclaimer, the term of this patent is extended or adjusted under 35 U.S.C. 154(b) by 245 days.

(21) Appl. No.: 12/402,812

(22) Filed: Mar. 12, 2009

(65) Prior Publication Data

US 2009/0236023 A1 Sep. 24, 2009

Related U.S. Application Data

(60) Provisional application No. 61/037,921, filed on Mar. 19, 2008.

(51) Int. Cl.
*B65C 3/00* (2006.01)

(52) U.S. Cl. ..... 156/556; 156/538; 156/539; 156/540; 156/582; 492/31; 492/33; 492/38

(58) Field of Classification Search ..... 156/285, 156/381, 386, 538–540, 556, 582, DIG. 5–DIG. 14; 492/31, 33, 38; *B65C 3/00*
See application file for complete search history.

(56) References Cited

U.S. PATENT DOCUMENTS

| | | | |
|---|---|---|---|
| 4,488,655 A | 12/1984 | Itsubo et al. | |
| 4,687,137 A | 8/1987 | Boger et al. | |
| 4,844,760 A | 7/1989 | Dickey | |
| 5,605,720 A | 2/1997 | Allen et al. | |
| 6,245,181 B1 | 6/2001 | Bright | |
| 6,401,787 B1 * | 6/2002 | Tsutsumi et al. | 156/542 |
| 2002/0043322 A1 | 4/2002 | Shiraishi | |
| 2007/0029036 A1 | 2/2007 | Fort et al. | |

FOREIGN PATENT DOCUMENTS

| | | |
|---|---|---|
| DE | 9102676 | 5/1991 |
| DE | 9102676 U1 * | 5/1991 |
| DE | 91 02 676 U1 | 7/1991 |
| DE | 29619522 | 1/1997 |
| EP | 0 101 278 A2 | 2/1984 |
| GB | 2015962 A | 9/1979 |
| GB | 2438704 A1 * | 8/2007 |
| GB | 2 438 704 A | 12/2007 |
| GB | 2438704 A | 12/2007 |

OTHER PUBLICATIONS

Online Translation of DE 9102676 U1.*
Full Translation of DE 9102676.*
US Patent and Trademark Office; Search Report in International Patent Application No. PCT/US08/72319 dated Oct. 22, 2008.
European Patent Office; Search Report in European Patent Application No. 09155389.1 dated Jul. 15, 2009.
European Patent Office; Supplemental Search Report/Written Opinion in International Patent Application No. PCT/US2008/072319 dated May 27, 2011; 8 pages.
The State Intellectual Property Office of the People's Republic of China; Office Action in Chinese Patent Application No. 200910128863.6 dated Jan. 9, 2012; 9 pages.

* cited by examiner

*Primary Examiner* — Christopher Schatz
(74) *Attorney, Agent, or Firm* — Wood, Herron & Evans, LLP

(57) ABSTRACT

In one aspect, a vacuum drum assembly for use with a labeling apparatus includes apertures for supporting labels on an outer surface using vacuum pressure. The vacuum drum assembly may include air distributors for providing vacuum pressure to selected apertures to accommodate various lengths or widths of labels. The vacuum drum assembly may also be adjustable to vary the spacing between apertures to accommodate various lengths of labels.

10 Claims, 17 Drawing Sheets

APPARATUS AND METHODS FOR DISPENSING ADHESIVE TO LABELS

CROSS-REFERENCE

This application claims the benefit of U.S. Provisional Patent Application Ser. No. 61/037,921, filed Mar. 19, 2008, the disclosure of which is incorporated by reference herein in its entirety. The present application is also related to International Patent Application No. PCT/US2008/72319 filed Aug. 6, 2008 (pending), the disclosure of which is incorporated by reference herein in its entirety.

TECHNICAL FIELD

The present invention generally relates to the application of labels to objects and, more particularly, to the application of adhesive coated labels to objects.

BACKGROUND

Labels may be made in various sizes and shapes, and may further fall into one of several types. One type of label, for example, is the wrap-around label, in which a leading edge of the label is initially secured with adhesive to a three dimensional object, such as a container or other product or product packaging of any shape. The label is then wrapped around the object so that the trailing edge of the label overlaps and is adhesively secured to the label itself. Another type of label is one in which both the leading and trailing edges of the label are affixed directly to the object.

The securement of labels to bottles or other containers, for example, must be of such a quality that the labels can withstand the various conditions that may be later experienced by the containers or bottles during shipping, storage, and use thereof subsequent to the product packaging or filling operation. For example, with bottles of carbonated beverages, the labels must withstand expansion of the bottles due to the carbonation of the beverage and, for example, additional expansion and contraction during shipping and storage operations in which the temperatures of the product may vary. Moreover, the labels must also be aesthetically pleasing. For example, it may be desired that the exposed edge of a label should not readily flap, become detached from the product, have exposed adhesive, or have large amounts of adhesive forming lumps underneath the label.

In some processes, adhesive is applied to labels using a wheel coater. Wheel coaters use an open reservoir for holding the adhesive. A rotating wheel receives a coating of adhesive on its outer circumference that in turn transfers the adhesive onto the label by rolling contact with the label. The labels may be supported on a vacuum drum during application of the adhesive. A container, such as a bottle, can, or other type of object moves along a conveyor and a paper or plastic label is secured to the outer surface of the container or object during a production operation. A drawback of wheel-applied adhesive is that the open reservoir is susceptible to contamination, which may affect the quality of applied labels and lower the efficiency of the machine. Wheel coaters also require precise settings to ensure adequate results of dispensed labels. These settings must be adjusted and finely tuned each time the labels are changed.

In some labeling operations, it may be desired to apply labels having different lengths and/or widths. This may require that the vacuum drum used to support the labels during adhesive application be changed to accommodate the differently sized labels. Changing vacuum drums requires shutting down the labeling line and therefore reduces throughput.

There is a need for a manner of applying adhesive to either labels or containers, or both, in which the adhesive may be applied in a non-contact fashion, but also with reduced needs for maintenance requirements and good adhesive coverage, while at the same time using a minimum amount of adhesive to secure a label to a container. There is also a need for increased control over the amount of adhesive that is applied, especially in applications where different amounts of adhesive are required for different portions of a label. There is also a need for a labeling apparatus that is capable of applying labels of various lengths and widths to containers.

SUMMARY

The present invention overcomes the foregoing and other shortcomings and drawbacks of devices heretofore known for use in applying labels to containers or other objects. While the invention will be described in connection with certain embodiments, it will be understood that the invention is not limited to these embodiments. On the contrary, the invention includes all alternatives, modifications and equivalents as may be included within the spirit and scope of the present invention.

In one aspect, a vacuum drum assembly for use in applying labels to objects includes a drum body having an outer peripheral surface and a plurality of apertures in the outer peripheral surface defining locations for supporting labels thereon. Each aperture is in communication with one of a plurality of passages in the drum body for developing vacuum pressure at the apertures. The vacuum drum assembly is adjustable to vary at least one of an axial configuration or a circumferential configuration of apertures to which vacuum pressure is applied, so that differently sized labels can be supported on the outer peripheral surface.

In another aspect, a vacuum drum body for use in applying labels to objects includes apertures on an outer peripheral surface of the drum body for supporting labels thereon when vacuum pressure is applied to the apertures. The vacuum pressure may be applied to selected ones of the apertures to accommodate labels of various lengths or widths. In one embodiment, the vacuum drum assembly includes air distributors disposed in bores through the drum body. The air distributors are adjustable to provide fluid communication between one or more apertures and a vacuum source. In another embodiment, the vacuum drum assembly includes at least one ring received on the vacuum body and being rotatable around the outer peripheral surface of the drum body. Apertures in the ring are in communication with a vacuum source for supporting labels on the drum body, and rotation of the ring adjusts the circumferential locations of the apertures to accommodate labels of varying lengths.

In another aspect, a method for applying labels to objects includes supplying vacuum pressure to at least some of a plurality of apertures in an outer peripheral surface of a vacuum drum, adjusting the vacuum drum to vary at least one of an axial configuration or a circumferential configuration of apertures to which vacuum pressure is applied so that labels having different sizes can be supported on the vacuum drum, and supporting a label on the outer peripheral surface of the vacuum drum.

The above and other objects and advantages of the present invention shall be made apparent from the accompanying drawings and the description thereof.

DETAILED DESCRIPTION

Figure 1:
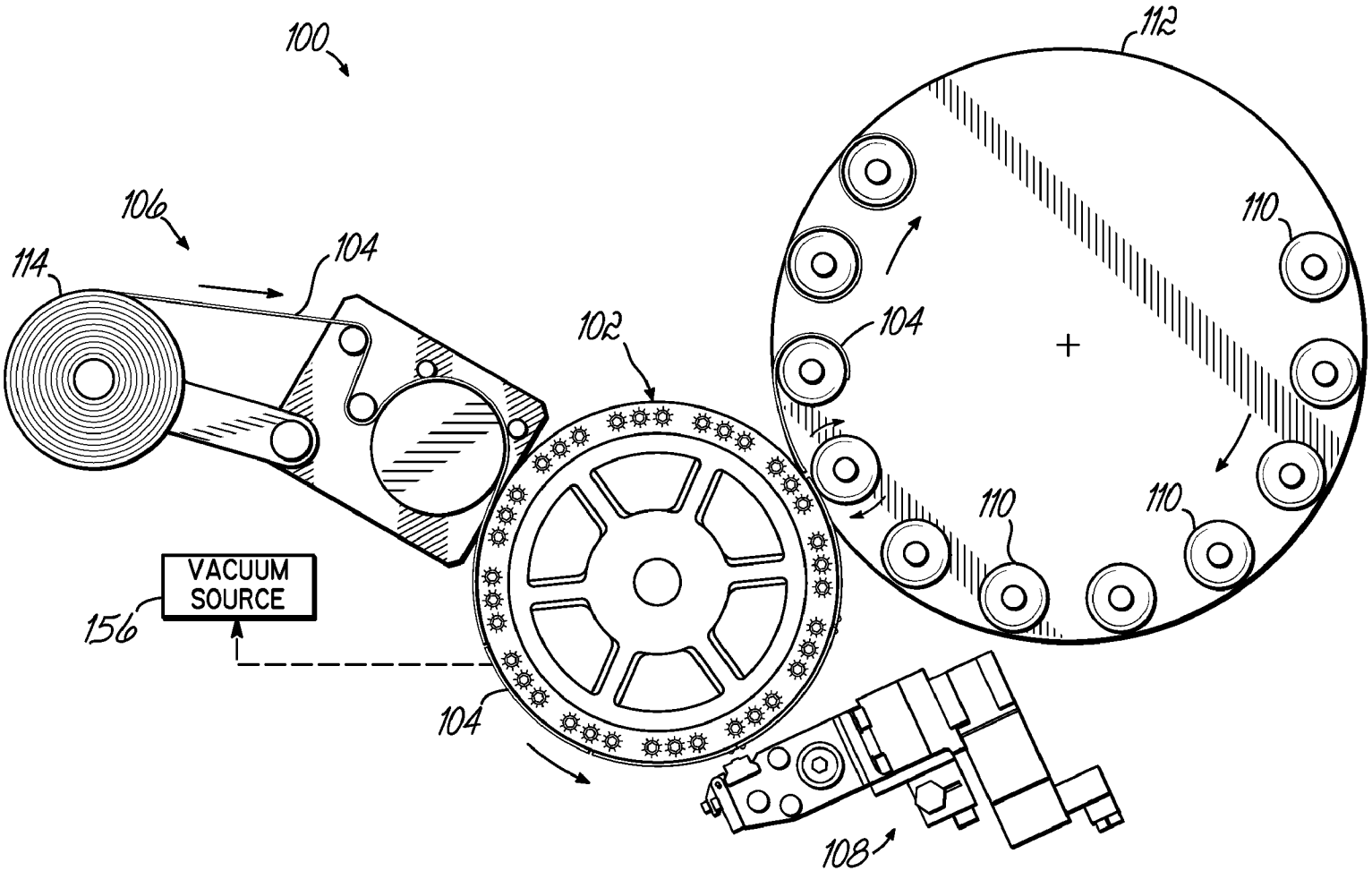
FIG. 1 is a plan view of an exemplary labeling apparatus in accordance with the present disclosure.

FIG. 1 depicts another exemplary labeling apparatus 100 in accordance with the principles of the present disclosure. The labeling apparatus 100 includes an exemplary vacuum drum assembly 102 for receiving labels 104 from a label feed device 106, moving the labels 104 past an adhesive dispensing gun 108, and applying the labels 104 to containers 110 moving past the vacuum drum assembly 102 on a conveyor 112. In the embodiment shown, the label feed device 106 is adapted to receive labels 104 from a roll 114 and to direct the labels 104 to the surface of the vacuum drum assembly 102. The labels 104 may be carried by the vacuum drum assembly 102 as a continuous web, or the labels 104 may be cut from the roll 114 while on the vacuum drum assembly 102 or prior to being transferred to the vacuum drum assembly 102. The label feed device 106 may include capstans and/or drive rollers to direct the labels 104 from the roll 114 to the surface of the vacuum drum assembly 102. While the label feed device 106 has been shown and described herein as being adapted to receive and deliver labels 104 to the vacuum drum assembly 102 from a roll 114, it will be appreciated that various other label feed devices may alternatively be used. For example, an alternative label feed device (not shown) may include a magazine for feeding a stack of precut labels to the vacuum drum assembly 102.

Figure 2:
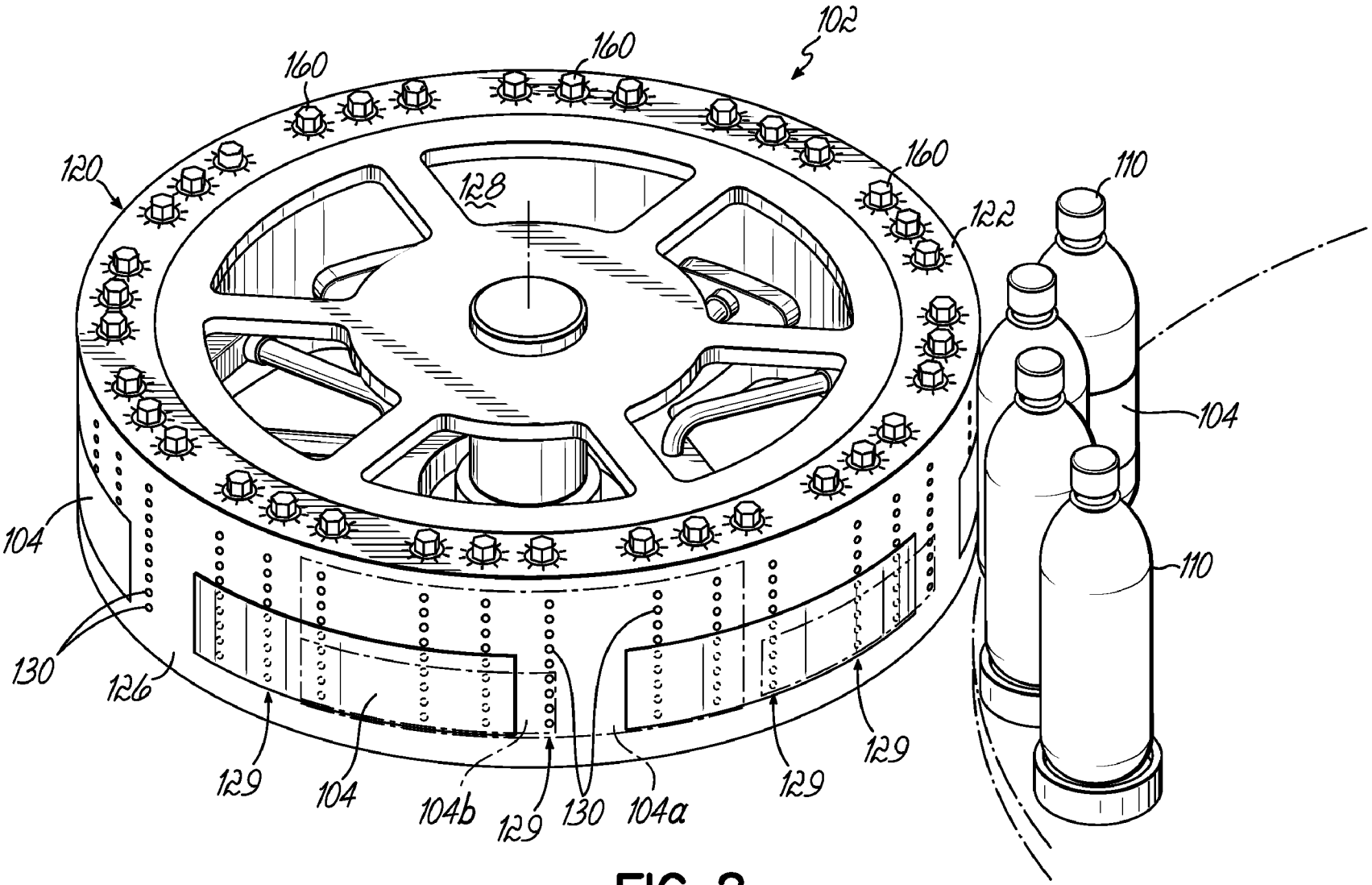
FIG. 2 is a perspective view of an exemplary vacuum drum assembly for use with the labeling apparatus of FIG. 1.
Figure 3:
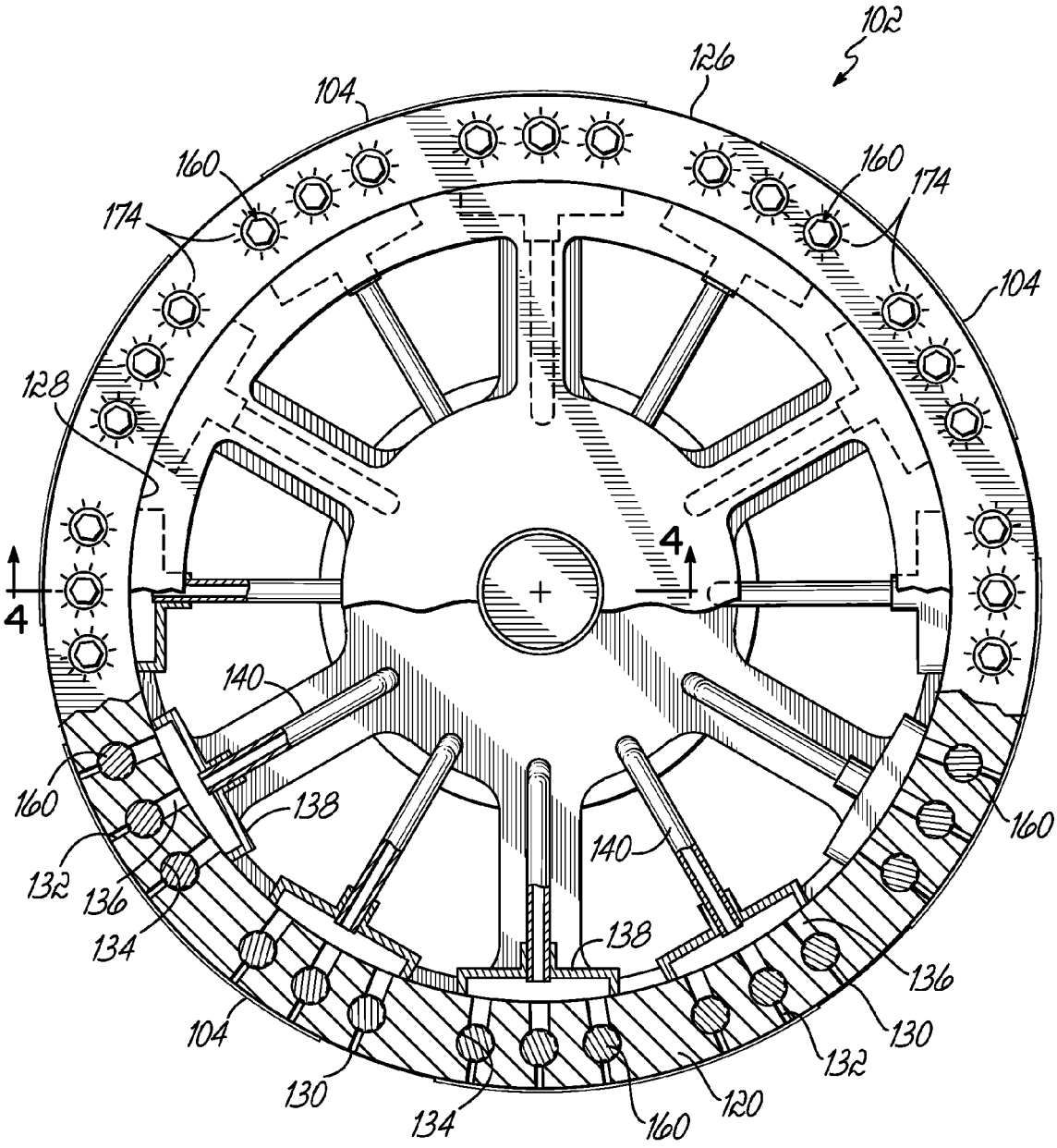
FIG. 3 is a top plan view of the vacuum drum assembly of FIG. 2 with broken sections illustrating detail.
Figure 4:
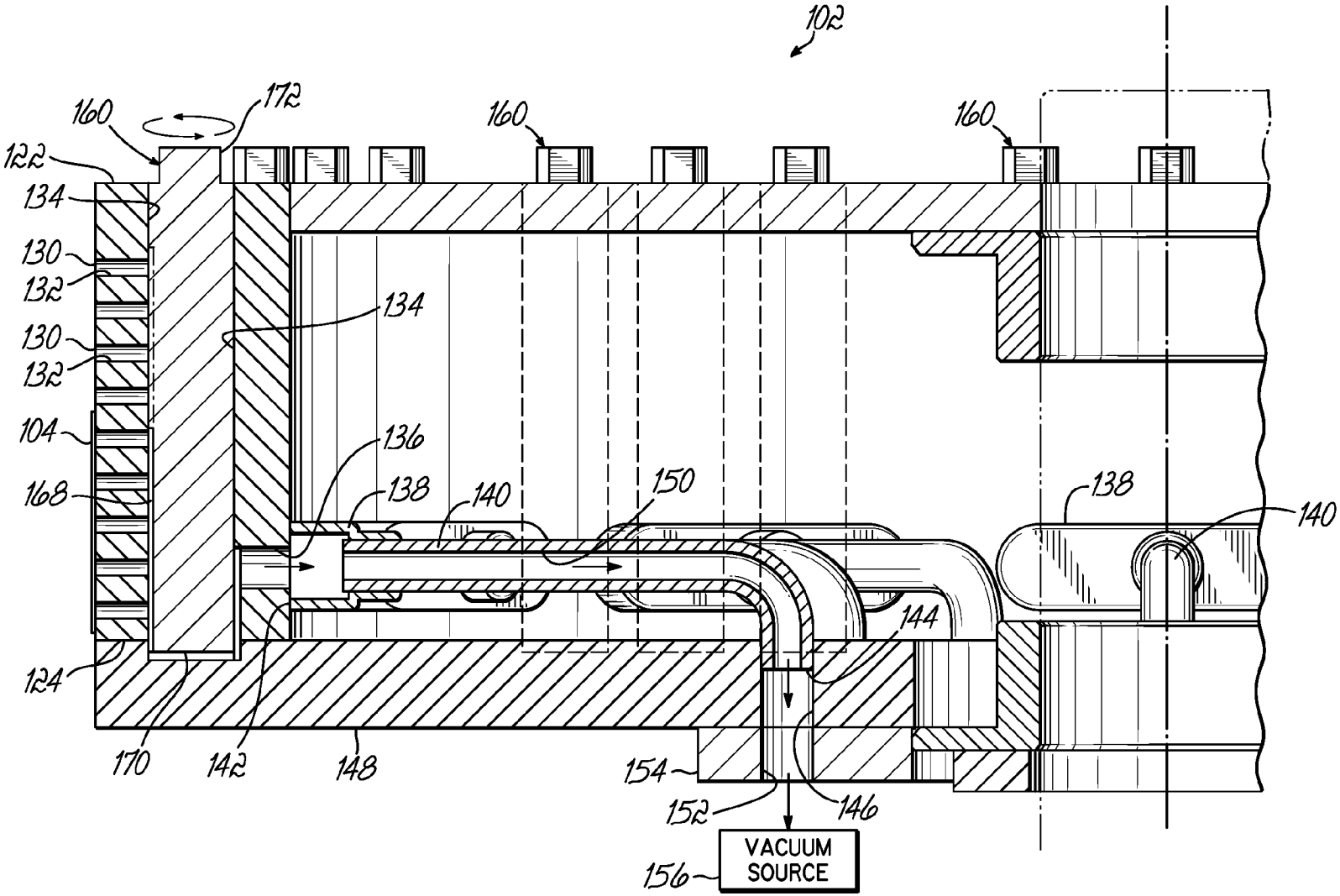
FIG. 4 is a partial section view of the vacuum drum assembly of FIG. 3, taken along line 4-4.

With continued reference to FIG. 1, and referring further to FIGS. 2-4, the vacuum drum assembly 102 includes a generally cylindrical drum body 120 having first and second axial ends 122, 124, an outer peripheral surface 126, and an inner peripheral surface 128. The outer peripheral surface 126 includes a plurality of apertures 130 arranged to provide vacuum pressure at locations for supporting labels 104 on the outer peripheral surface 126.

In one aspect, the adhesive dispensing gun 108 may be a non-contact type adhesive dispensing gun, such as an E.Dot® gun, available from Nordson Corporation of Westlake, Ohio, wherein adhesive is applied to the labels 104 as they are moved past the adhesive dispensing gun 108 without the adhesive dispensing gun 108 coming into contact with the labels 104. Because the adhesive dispensing gun 108 does not contact the labels 104, the drum body 120 may be formed with the outer peripheral surface 126 located a constant radius from a center of the drum body 120 around the entire circumference of the drum body 120. It will be appreciated that various other types of adhesive dispensing guns may alternatively be used to apply adhesive to labels 104, such as piezoelectric guns, pneumatic guns, or jetting dispensers, for example.

The apertures 130 in the outer peripheral surface 126 of the drum body 120 are arranged in a plurality of generally axial aligned rows 129 that are spaced around the outer peripheral surface 126, as depicted in FIG. 2. Each aperture 130 is in fluid communication with one of a plurality of radially extending outer passages 132 through the drum body 120. The drum body 120 further includes a plurality of axial bores 134 extending from the first axial end 122 of the drum body 120 to the second axial end 124 of the drum body 120. Each bore 134 is associated with one of the axially aligned rows 129 of apertures 130. The axial bores 134 also communicate with respective radially extending inner passages 136, which are aligned in registration with the inlets of vacuum housings 138 coupled to the inner peripheral surface 128 of the drum body 120. In the embodiment shown, each vacuum housing communicates with three inner passages 136, but it will be appreciated that the vacuum housings 138 may alternatively be associated with only one inner passage 138, or any number of inner passages 138 as may be desired.

The vacuum drum assembly 102 further includes vacuum conduits 140 having first ends 142 coupled to the vacuum housings 138 and second ends 144 coupled to respective axial bores 146 through a base plate 148 that is coupled to the second axial end 124 of the drum body 120. A fluid passage 150 through each vacuum conduit 140, between the first and second ends 142, 144, provides fluid communication between the vacuum housings 138 and the axial bore 146 through the base plate 148. The axial bores 146 of the base plate 148 are aligned in registration with corresponding bores 152 through a vacuum plate 154 that is operatively coupled to the base plate 148. Bores 152 are in fluid communication with a vacuum source 156. Accordingly, when vacuum pressure is applied by the vacuum source 156 to the bores 152 in the vacuum plate 154, air is drawn through the plurality of apertures 130 in the outer peripheral surface 126 of the drum body 120, through the outer passages 132, through the axial bores 134, through the inner passages 136, through the vacuum housings 138, through the vacuum conduits 140, and through the bores 146, 152 in the base plate 148 and vacuum plate 154, so that a label 104 applied to the outer peripheral surface 126 of the drum body 120 may be held thereon by vacuum pressure.

In another aspect, vacuum pressure to bores 146 in base plate 148 may intermittently be shut off, or bores 146 may also be intermittently exposed to a positive pressure, to facilitate transferring labels 104 from the outer peripheral surface 126 of the drum body 120 to containers 110 or other objects. Intermittent application of vacuum pressure and/or positive pressure to bores 146 may be accomplished, for example, by selective arrangement of bores through the vacuum plate 154, such as bores 152, whereby bores 146 through base plate 148 are periodically aligned in registration with the bores through the vacuum plate 154 for exposure to vacuum and or positive pressure as the drum body 120 rotates.

Figure 5:
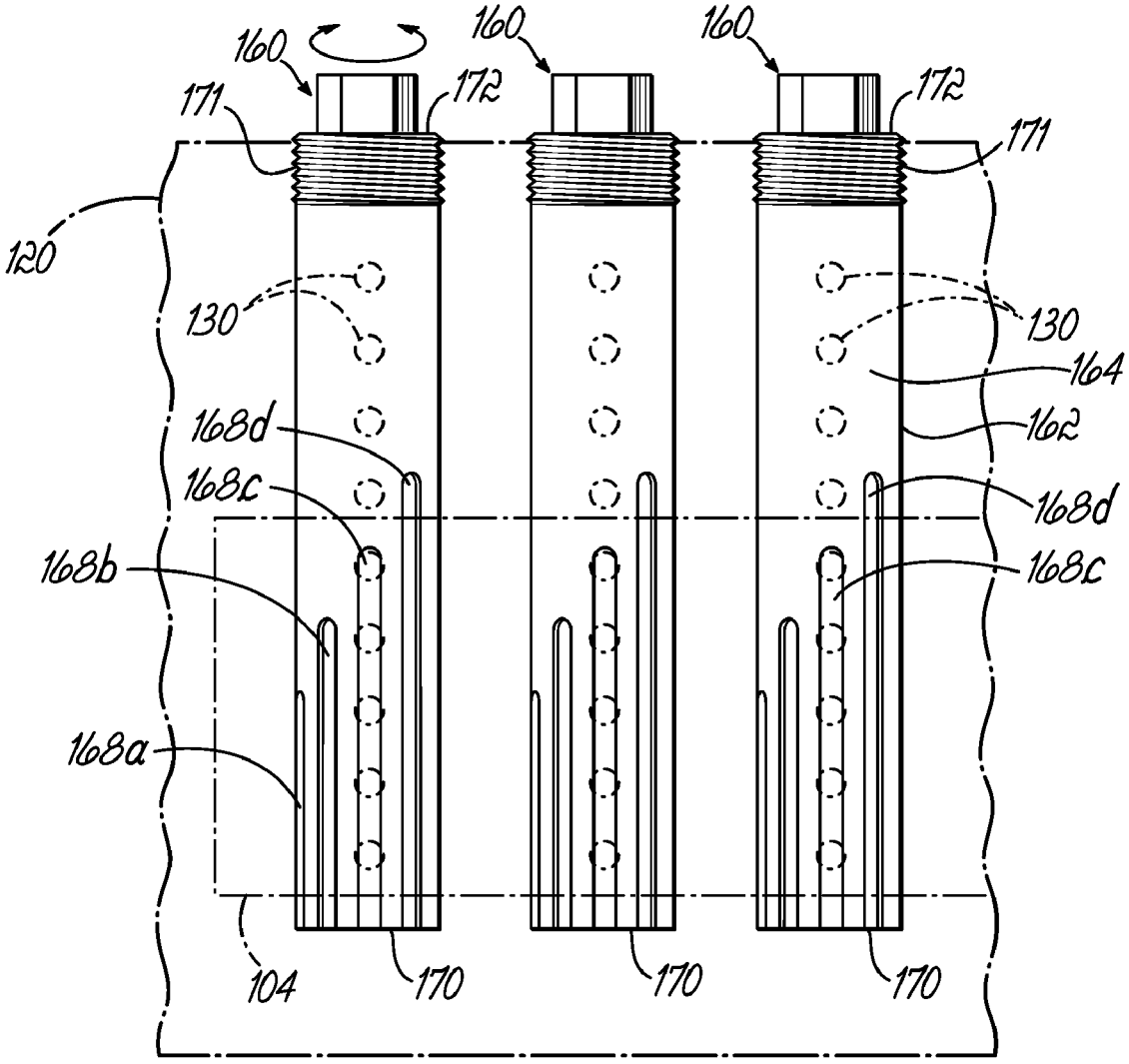
FIG. 5 is a schematic illustration of the vacuum drum assembly of FIG. 2 and illustrating communication between air distributors and apertures in the drum body.
Figure 6A:
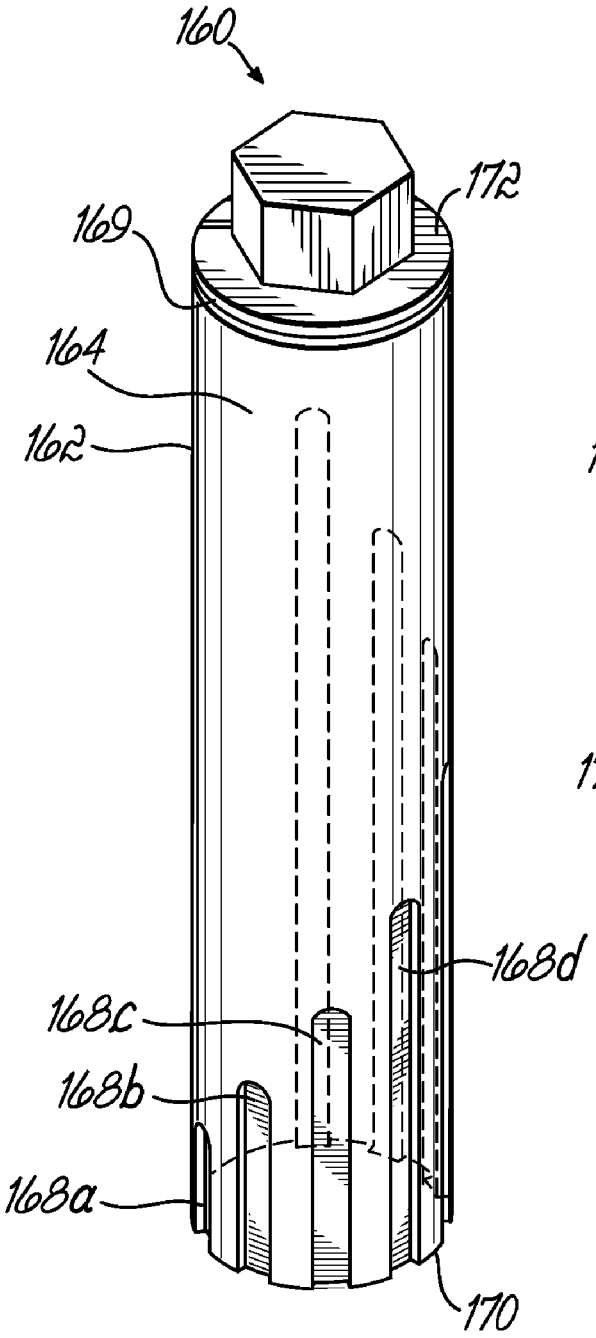
FIG. 6A is a perspective view of an air distributor of FIG. 5.

With continued reference to FIGS. 1-4, and referring further to FIGS. 5 and 6A, the vacuum drum assembly 102 may further include air distributors 160 provided in each axial bore 134 through the drum body 120. The air distributors 160 may be adjusted to selectively provide fluid communication between the vacuum source 156 and one or more of the apertures 130 in the outer peripheral surface 126 of the drum body 120. In the embodiment shown, the air distributors 160 comprise generally elongate cylindrical distributor bodies 162 rotatably disposed in respective axial bores 134 of the drum body 120. Each distributor body 162 has an outer circumferential surface 164 and at least one recess 168 formed into the outer circumferential surface 164 to provide selective fluid communication between one or more of the apertures 130 in an associated row 129 of apertures 130 as the distributor body 162 is rotated within the bore 134.

With continued reference to FIGS. 5 and 6A, an exemplary air distributor 160 includes a plurality of recesses in the form of elongate slots 168*a*, 168*b*, 168*c*, 168*d*, etc. formed into the outer circumferential surface 164 of the distributor body 162 and extending in a direction from a second end 170 of the distributor body 162 toward a first end 172 of the distributor body 162. The first end 172 of the distributor body 162 may include a feature, such a hex head or other structure, to facilitate manipulation of the air distributor 160 for rotation within an axial bore 134 of the drum body 120. Each elongate slot 168*a*, 168*b*, 168*c*, 168*d*, etc. on the outer circumferential surface 164 of the distributor body 162 extends a different length from the second end 170 toward the first end 172. As the distributor body 162 is rotated within the bore 134, different numbers of apertures 130 in an axially aligned row 128 may be brought into registration with one of the slots 168*a*, 168*b*, 168*c*, 168*d*, etc., as depicted in FIG. 5.

As shown in FIG. 4, bore 134 may be configured to provide fluid communication between the recess 168 and the respective inner passages 136 of the drum body 120, whereby vacuum pressure may be developed at apertures 130 aligned in registration with the recess 168. The first axial end 122 of the drum body 120 may include indicia 174 proximate each of the axial bores 134 to indicate a desired rotational position of an air distributor 160 received in the bore 134 and to facilitate aligning a desired number of apertures 130 in registration with recess 168.

Figure 6B:
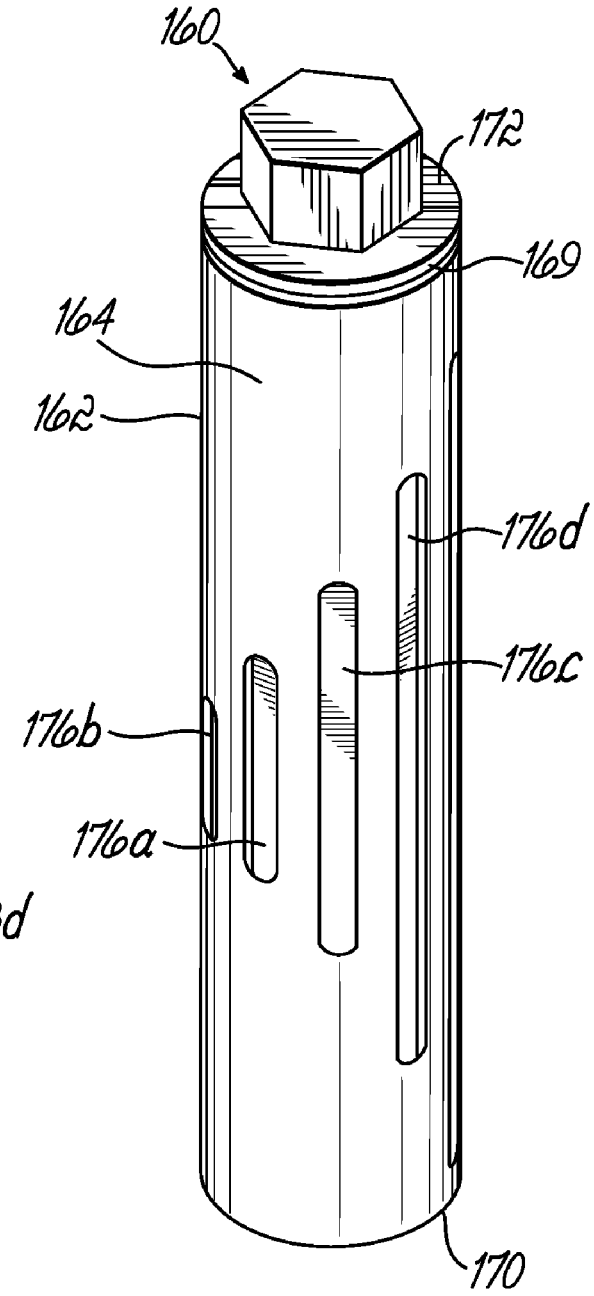
FIG. 6B is a perspective view of a second exemplary air distributor for use with a vacuum drum assembly.
Figure 6C:
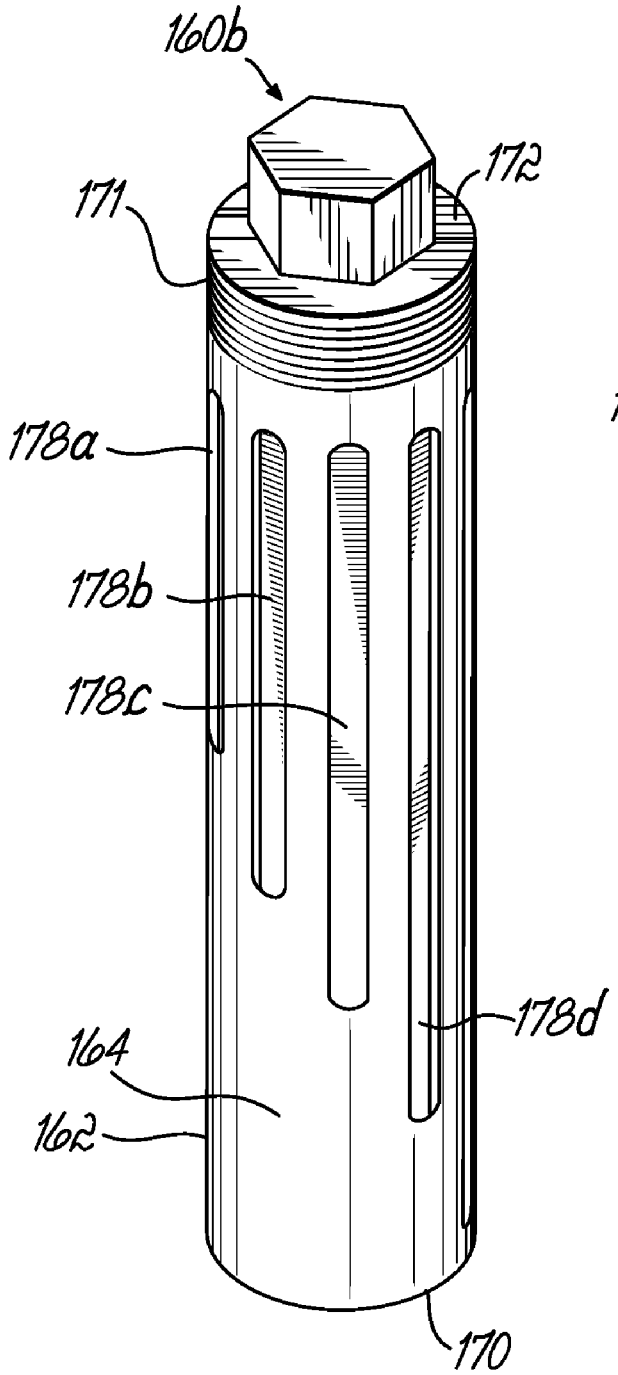
FIG. 6C is a perspective view of a third exemplary air distributor for use with a vacuum drum assembly.

FIG. 6B depicts an alternative embodiment of an air distributor 160*a*, similar to the air distributor 160 of FIG. 6A, but wherein the recess in the outer circumferential surface 164 comprises axially extending slots 176*a*, 176*b*, 176*c*, 176*d*, etc. that are centered generally about a longitudinal midpoint of the distributor body 162. Each slot 176*a*, 176*b*, 176*c*, 176*d*, etc. extends axially from the longitudinal midpoint of the distributor body 162 in directions toward the first and second ends 172, 170 of the distributor body 162. FIG. 6C depicts another exemplary embodiment of an air distributor 160*b*, similar to air distributors 160, 160*a* depicted in FIGS. 6A and 6B, but wherein the recess comprises a plurality of axially extending slots 178*a*, 178*b*, 178*c*, 178*d*, etc. originating near the first end 172 of the distributor body 162 and extending in directions toward the second end 170 of the distributor body 162. It will be appreciated that the use of air distributors 160*a*, 160*b* as depicted in FIGS. 6B and 6C may require modification of the bores 134 and inner passages 136 through the vacuum drum body 120 to facilitate selective communication between the vacuum source 156 and one or more of the apertures 130 in the outer peripheral surface 126 of the drum body 120 by adjustment of the air distributors 160*a*, 160*b*.

Figure 6D:
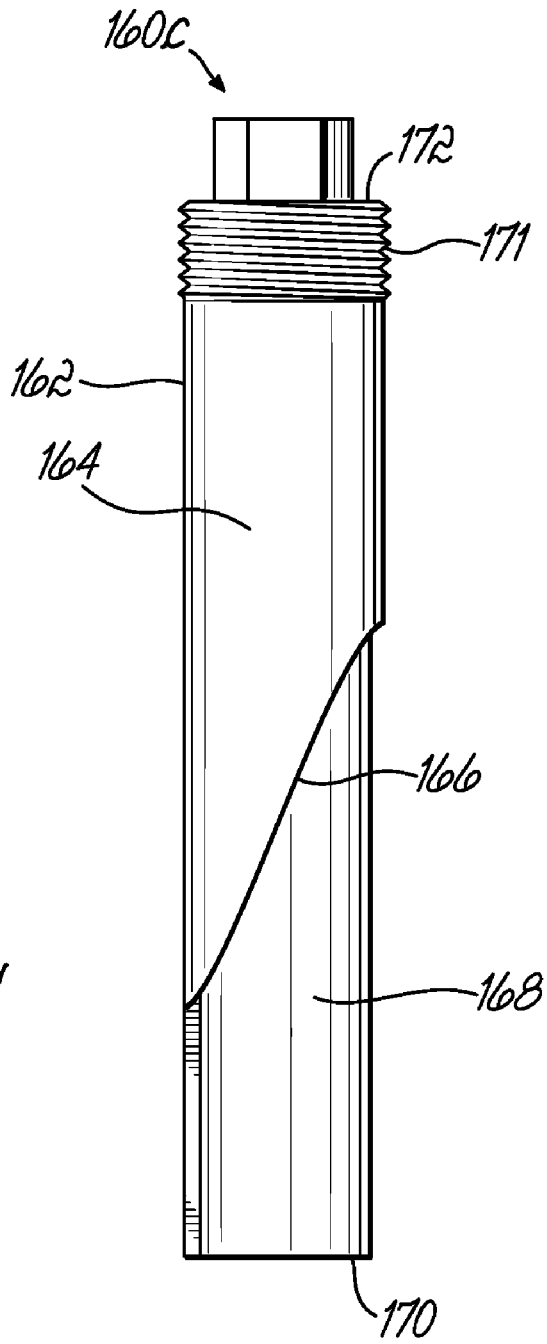
FIG. 6D is a perspective view of a fourth exemplary air distributor for use with a vacuum drum assembly.
Figure 7:
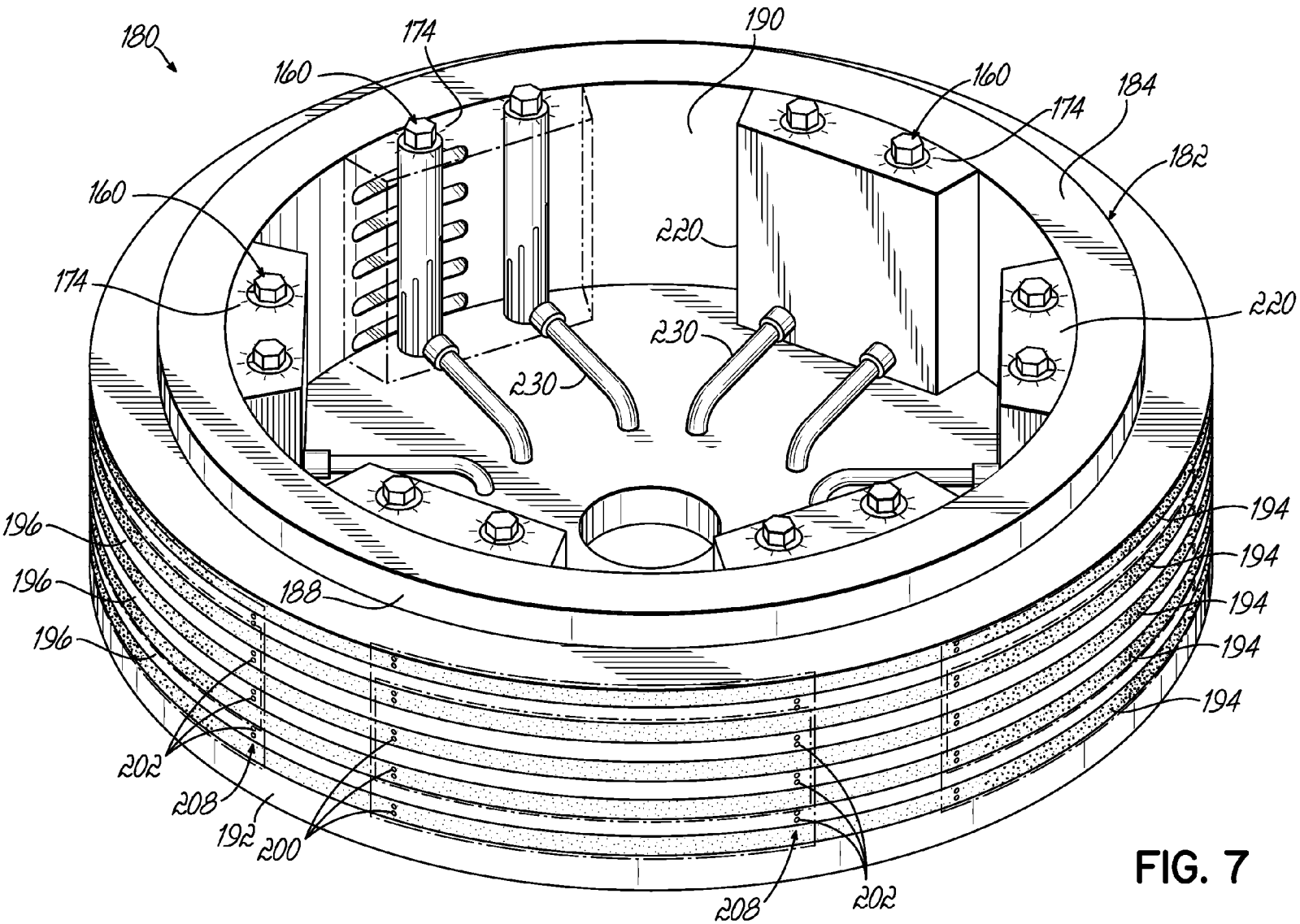
FIG. 7 is a perspective view of another exemplary vacuum drum assembly for use with the labeling apparatus of FIG. 1.

FIG. 6D depicts yet another exemplary air distributor 160*c* for use with the vacuum drum assembly 102 described above. In this embodiment, the recess 168 in the outer circumferential surface of the distributor body is defined by a generally helically shaped ledge 166 extending axially and circumferentially around the distributor body 162 whereby rotation of the air distributor 160*c* within the bore 134 of the drum body 120 selectively exposes one or more apertures 130 to the recess 168 to provide vacuum pressure at the apertures 130, in a manner similar to that described above.

Air distributors 160, 160*a*, 160*b*, 160*c* may further include features that facilitate retaining the air distributors in the bores 134. As a non-limiting example, FIGS. 5, 6C, and 6D depict air distributors 160, 160*b*, 160*c* having screw threads 171 formed into distributor bodies 162 near the first ends 172. In another non-limiting example, FIGS. 6A and 6B depict air distributors 160, 160*a* having grooves 169 proximate the first ends 172 for receiving snap rings. It will be appreciated that various other structures may alternatively be used to facilitate retaining air distributors 160, 160*a*, 160*b*, 160*c* in bores 134.

FIGS. 7, 8A, 8B, and 9 depict another exemplary vacuum drum assembly 180 for use with the labeling apparatus 100 described above. In this embodiment, the vacuum drum 180 assembly includes a generally cylindrically-shaped drum body 182 having a first axial end 184, a second axial end 186, an outer peripheral surface 188, and an inner peripheral surface 190. A disk-shaped base plate 192 is coupled to the second axial end 186 of the drum body 182. One or more rings 194, 196 are received over the outer peripheral surface 188 of the drum body 182. In the embodiment shown, the vacuum drum assembly 180 includes a plurality of first rings 194 and second rings 196 stacked upon one another in an alternating arrangement.

First and second apertures 200, 202 are formed in the outer peripheral surfaces of the first and second rings 194, 196. The first and second apertures 200, 202 are in fluid communication with respective radially extending first and second passages 204, 206 through the first and second rings 194, 196. In the embodiment shown, the second rings 196 are fixed in position relative to the drum body 182 and the second apertures 202 are aligned in generally axially extending rows 208 that are spaced around the outer circumferences of the second rings 196. The first rings 194 are rotatable around the outer peripheral surface 188 of the drum body 182 to permit selective adjustment of the locations of the first apertures 200 formed through the first rings 194. The first rings 194 may be configured such that all of the first rings 194 move in unison, or they may be configured such that the first rings 194 can be moved independently of one another.

Figure 8A:
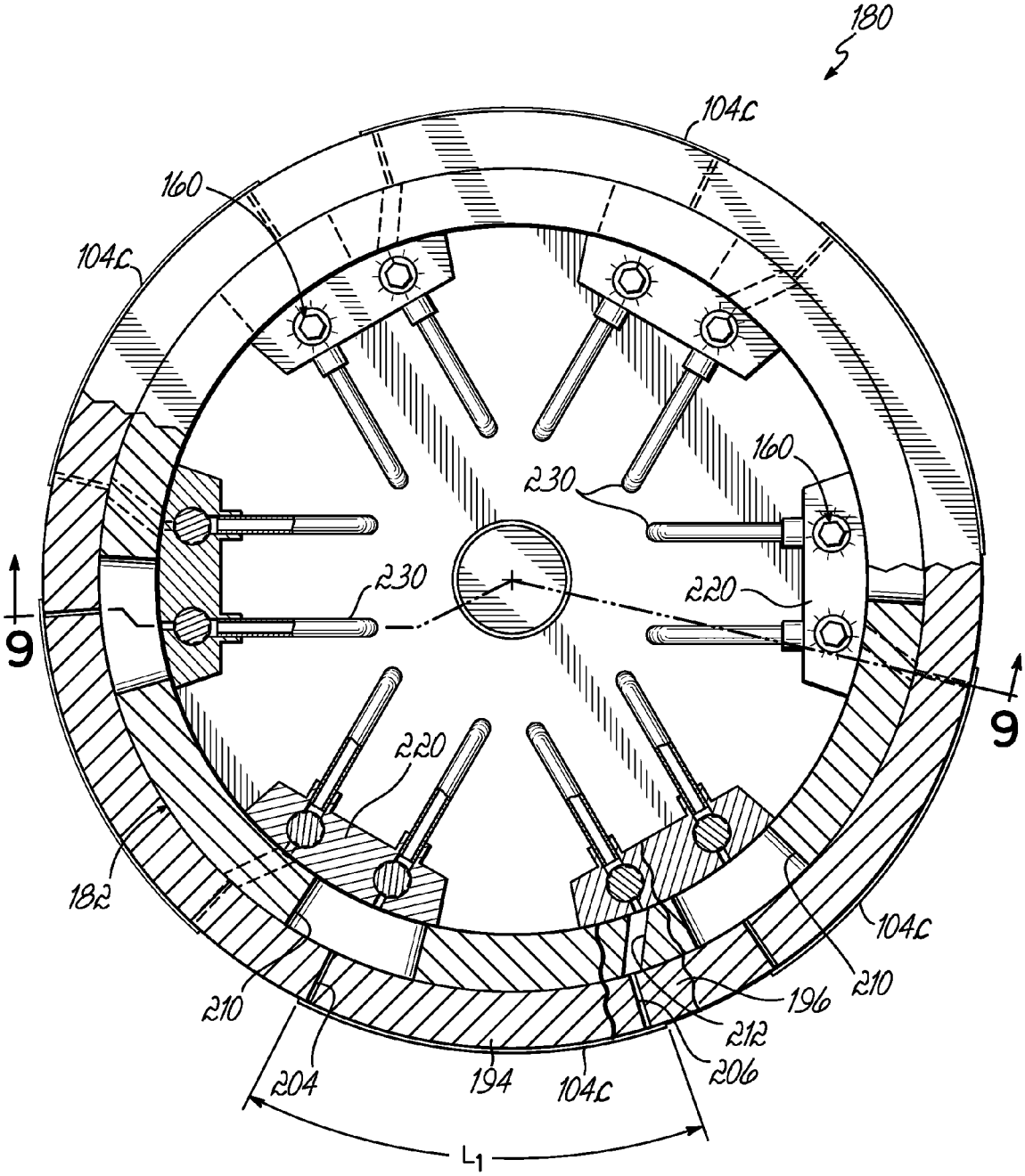
FIG. 8A is a top plan view of the vacuum drum assembly of FIG. 7 in a first configuration for accommodating labels of length L1.
Figure 8B:
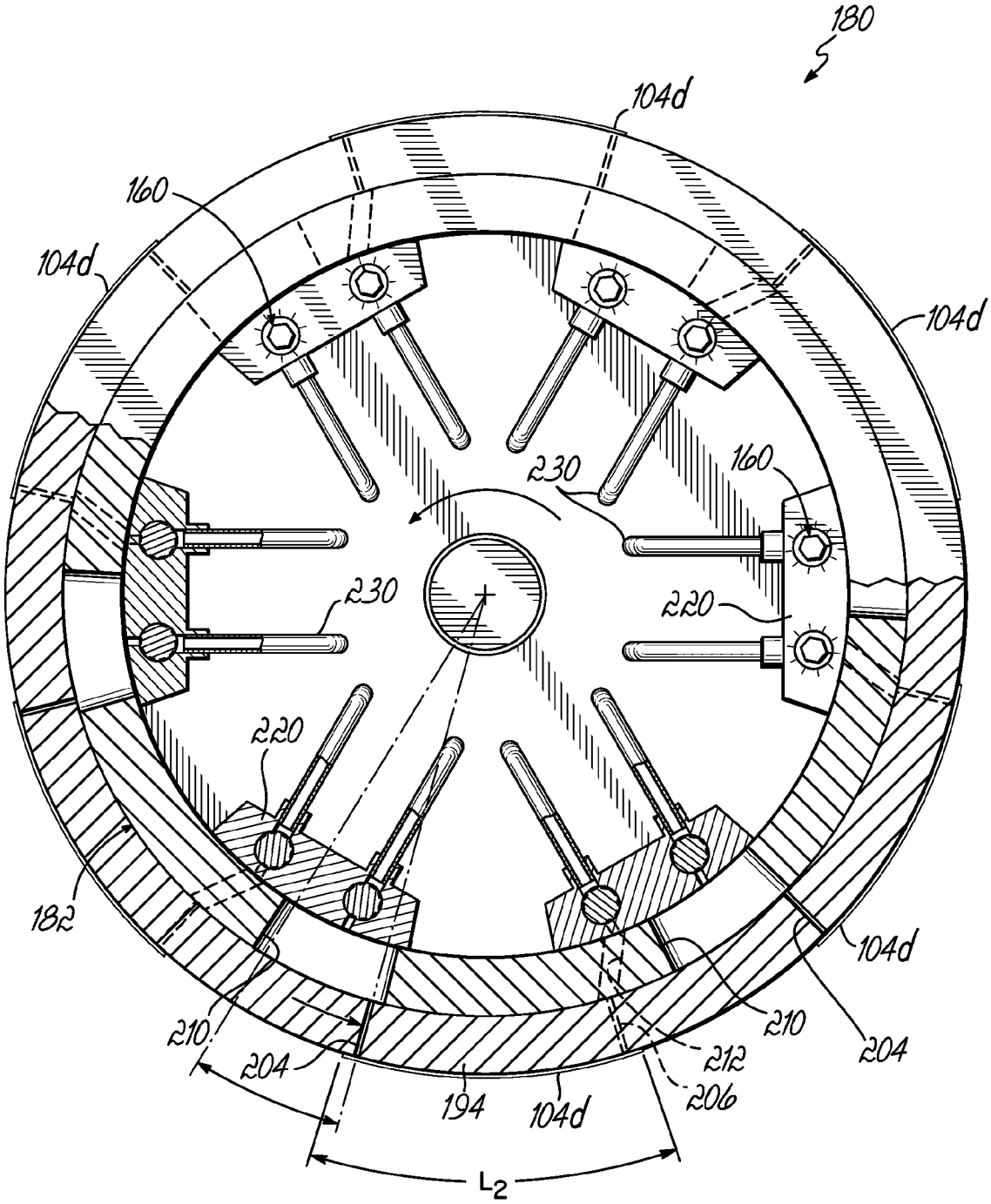
FIG. 8B is a top plan view of the vacuum drum assembly of FIG. 7 in a second configuration for accommodating labels of length L2.

Each of the first and second passages 204, 206 through the first and second rings 194, 196 is in fluid communication with one of a plurality of respective first and second passageways 210, 212 extending between the inner and outer peripheral surfaces 188, 190 of drum body 182. In the embodiment shown, the first passageways 210 through the drum body 182 are in fluid communication with the first passages 204 through the first rings 194 and comprise elongated slots extending generally in a circumferential direction around the drum body 182 to maintain fluid communication between the first passages 204 and the first passageways 210 of the drum body 182 as the first rings 194 are rotated circumferentially around the outer peripheral surface 188 of the drum body 182, as depicted in FIGS. 8A and 8B. The second passageways 212 are in fluid communication with the second passages 206 in the fixed second rings 196.

The vacuum drum assembly 180 further includes a plurality of vacuum housings 220 coupled to the inner peripheral surface 190 of the drum body 182 at locations corresponding to the first and second passageways 210, 212 through the drum body 182. In the embodiment shown, each vacuum housing 220 is associated with one axially aligned row of first passageways 210 and one axially aligned row of second passageways 212. The vacuum housings 220 include an axially aligned row of first ports 222 in fluid communication with the first passageways 210, and an axially aligned row of second ports 224 in fluid communication with the second passageways 212. Each vacuum housing further includes axial bores 226 for receiving air distributors 160. In the exemplary embodiment shown, the air distributors 160 are similar to those described above with respect to FIGS. 4, 5, and 6A-6D. Each axial bore 226 is in fluid communication with either the axially aligned row of first ports 222 or the axially aligned row of second ports 224. The bores 226 are configured to provide fluid communication between the first and second ports 222, 224 and vacuum housing outlets 228 by selective rotation of the air distributors 160 to align recesses 168 in the air distributors 160 with one or more of the first and second ports 222, 224, in a manner similar to that described above.

The vacuum drum assembly 180 further includes vacuum conduits 230 with first ends 232 coupled to respective outlets 228 of the vacuum housings 220 and second ends 234 coupled to axially extending bores 236 through the base plate 192. The axially extending bores 236 through the base plate 192 are in fluid communication with corresponding bores 238 through a vacuum plate 240 coupled to the base plate 192. Bores 230 are in communication with a vacuum source 156. Accordingly, vacuum pressure may be provided to selected first and second apertures 200, 202 on the first and second rings 194, 196 by fluid communication with the vacuum source 156 through the first and second passages 204, 206 of the first and second rings 194, 196, through the first and second passageways 210, 212 of the drum body 182, through the first and second ports 222, 224 of the vacuum housings 220, through outlets 228, through fluid passages 242 of vacuum conduits 230, and through bores 236, 238 of base plate 192 and vacuum plate 240, respectively.

In one embodiment, the second apertures 202 in the second rings 196 correspond to locations where the leading edges of labels 104 are supported by the vacuum drum assembly 180, and the first apertures 200 through the first rings 194 correspond to locations of trailing edges of labels 104 supported by the vacuum drum assembly 180. Because the first rings 194 may be rotatably adjusted around the outer peripheral surface 188 of the vacuum drum body 182, the locations of the first apertures 200 through the first rings 194 may be selectively adjusted to accommodate supporting labels 104 of different lengths. For example, FIG. 8A depicts vacuum drum assembly 180 with first rings 194 in a first position suitable for supporting labels 104*c* of length L1 on the vacuum drum assembly 180. FIG. 8B depicts vacuum drum assembly 180 with first rings 194 in a second position suitable for supporting labels 104*d* of length L2 on the vacuum drum assembly 180, wherein L2 is less than L1. While first rings 194 are adjustable to accommodate various label lengths, the air distributors 160 are adjustable to accommodate various label widths, as described above.

Figure 8C:
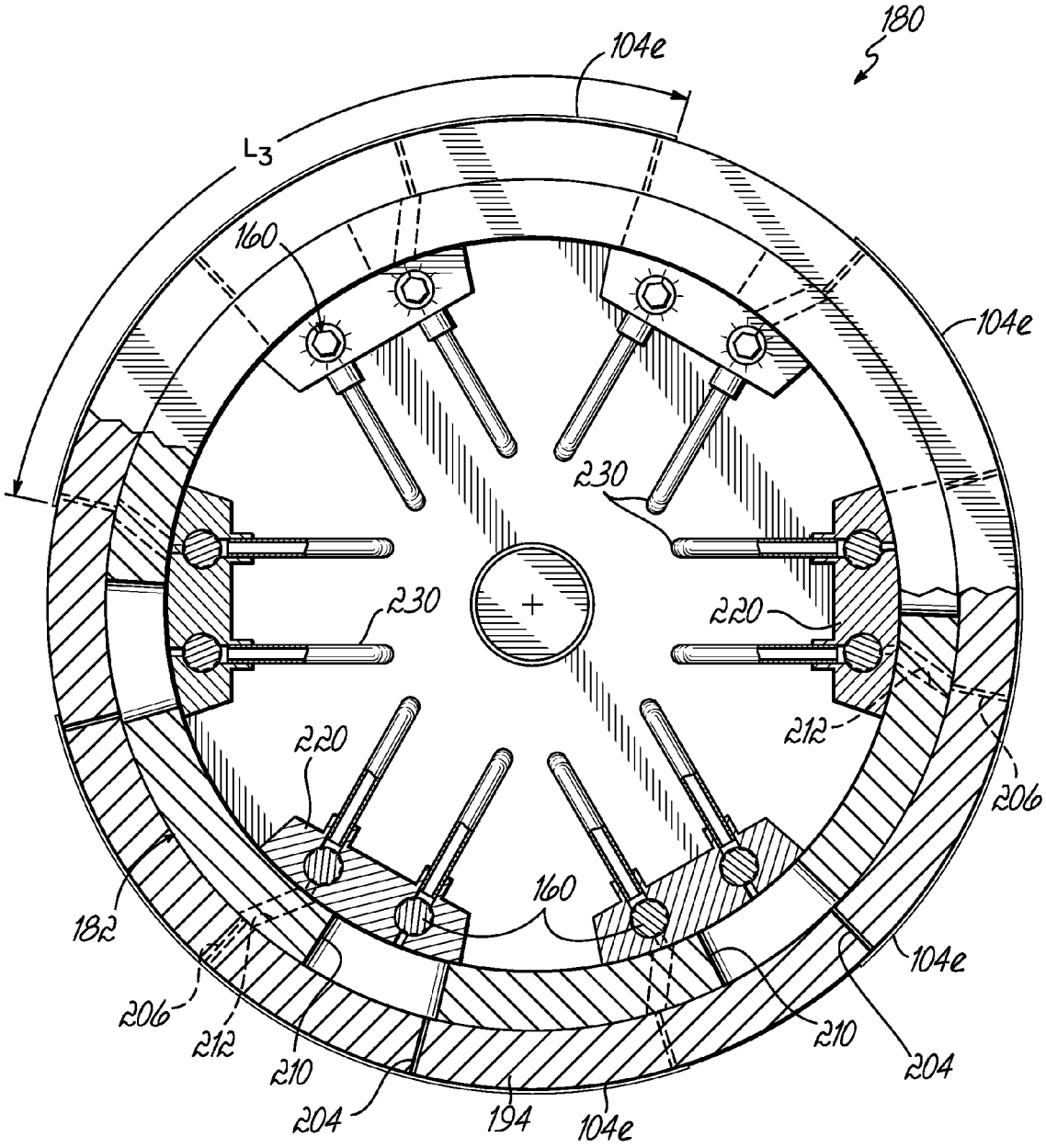
FIG. 8C is a top plan view of another exemplary vacuum drum assembly, similar to FIGS. 8A-8B, configured to accommodate longer labels of length L3.
Figure 9:
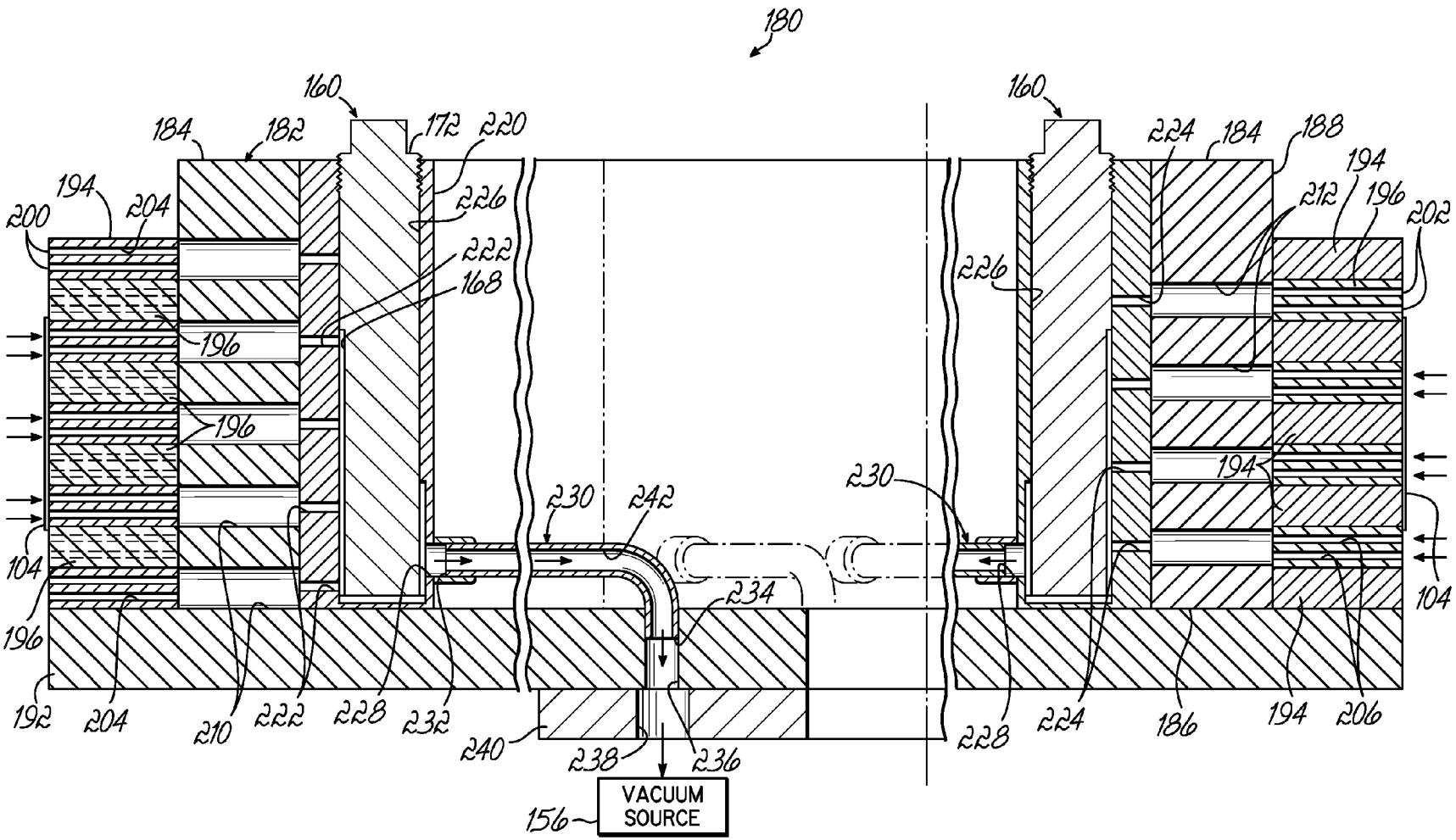
FIG. 9 is a partial cross-sectional view of the vacuum drum assembly of FIG. 8A, taken along line 9-9.

FIG. 8C depicts vacuum drum assembly 180 in a configuration suitable for supporting longer labels 104*e* of length L3. In this configuration first and second apertures 200, 202 associated with three different vacuum housings 220 are used to support each label 104*e*. The exemplary vacuum drum assembly 180, shown and described herein with six vacuum housings 220, may therefore be capable of supporting either six or three labels 104 at a time, depending on the lengths of the labels 104. It will be appreciated, however, that vacuum drum assemblies may alternatively include a fewer or greater number of vacuum housings and associated air distributors, as may be desired, to accommodate various numbers and arrangements of labels 104 on the vacuum drum assemblies.

Figure 10:
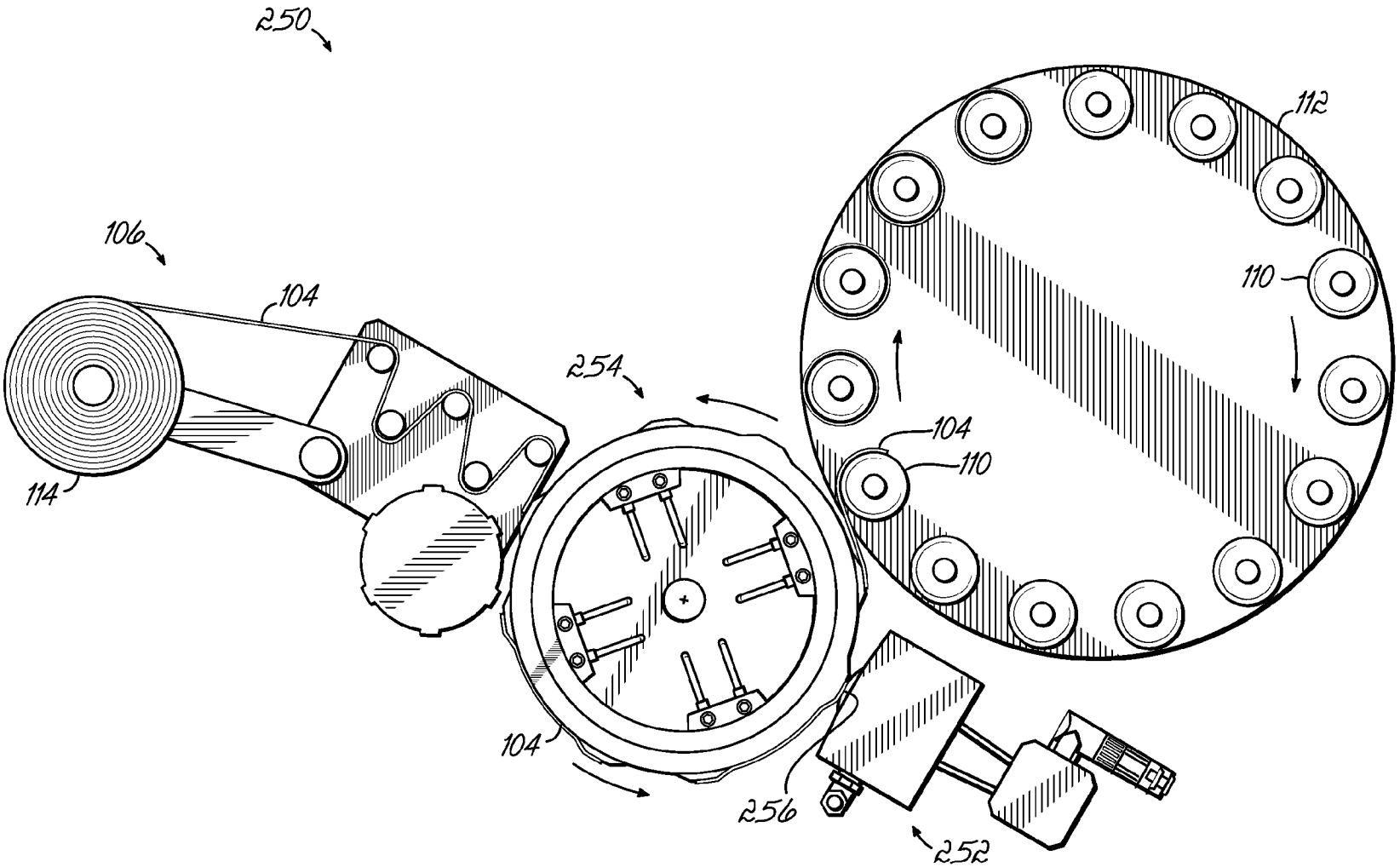
FIG. 10 is a plan view of yet another exemplary labeling apparatus, for use with an adhesive wheel coater.

FIG. 10 depicts another exemplary labeling apparatus 250 similar to that described above, but wherein adhesive is applied to labels 104 using an adhesive wheel coater 252. The labeling apparatus 250 includes an exemplary vacuum drum assembly 254 that receives labels 104 from a label feed device 106, as described above. The labels 104 are carried by the vacuum drum assembly 254 past the adhesive wheel coater 252 where an applicator wheel 256 applies adhesive to leading and trailing edges of the labels 104 by contact with the labels 104. Thereafter, the labels 104 are applied to containers 110 moving along a conveyor 112 in a manner similar to that described above.

FIGS. 11, 12A, 12B, and 13 depict exemplary vacuum drum assembly 254 for use with the labeling apparatus 250 of FIG. 10 in more detail. The vacuum drum assembly 254 of FIGS. 11, 12A, 12B, and 13 is similar to the vacuum drum assembly 180 discussed above with respect to FIGS. 7-10, and similar features have been similarly numbered. Vacuum drum assembly 254 further includes raised first and second lands 260, 262 extending radially outwardly from the first and second rings 194, 196 received on the outer peripheral surface 188 of drum body 182. The first and second lands 160, 162 provide contact between the applicator wheel 256 of the adhesive wheel coater 252 and the leading and trailing edges of labels 104. The first and second lands 260, 262 may be integrally formed with the first and second rings 194, 196, or they may be manufactured as separate components that are subsequently coupled to the respective first and second rings 194, 196.

Figure 12A:
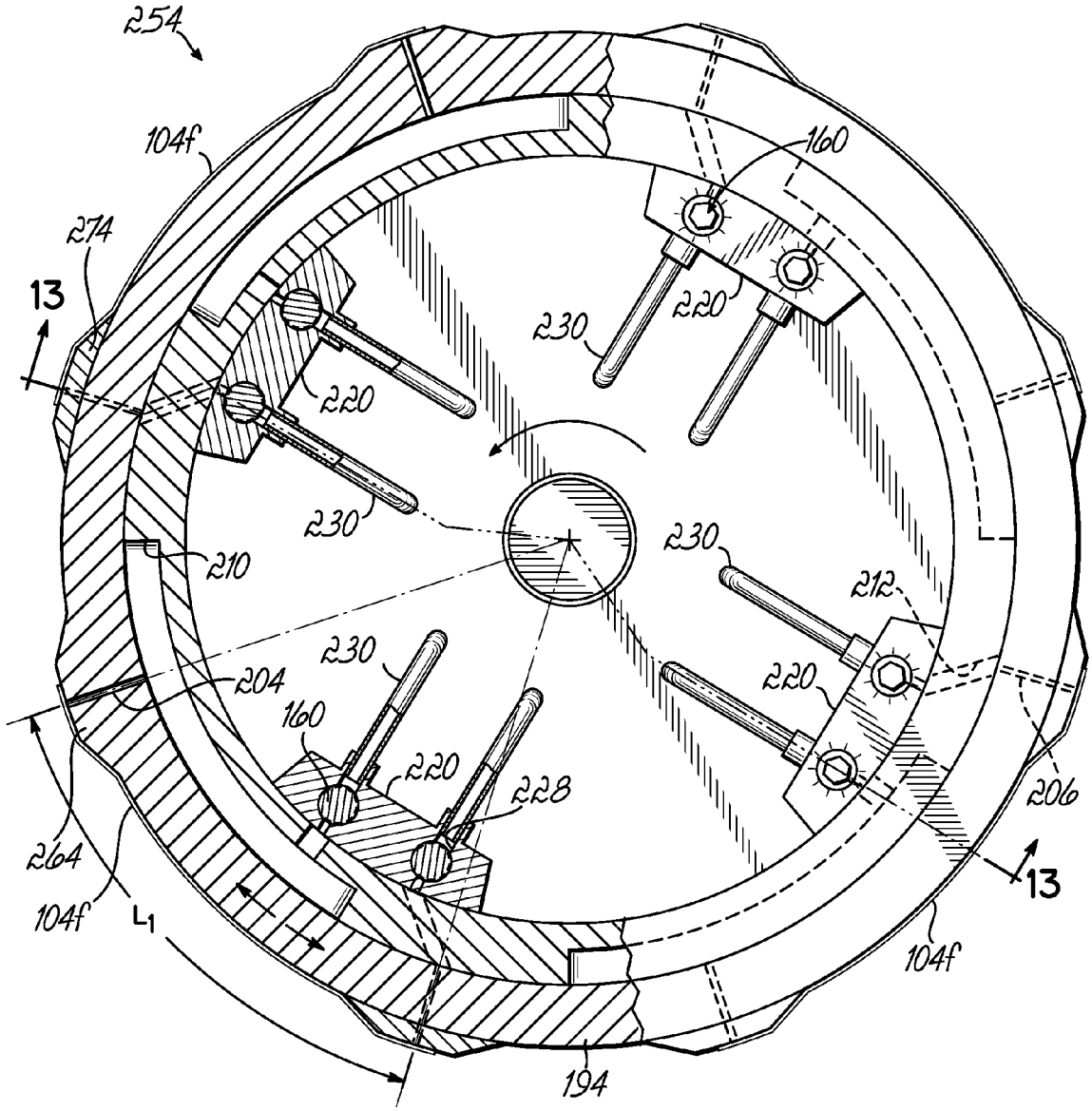
FIG. 12A is a top plan view of the vacuum drum assembly of FIG. 11 in a first configuration for accommodating labels of length L1.
Figure 12B:
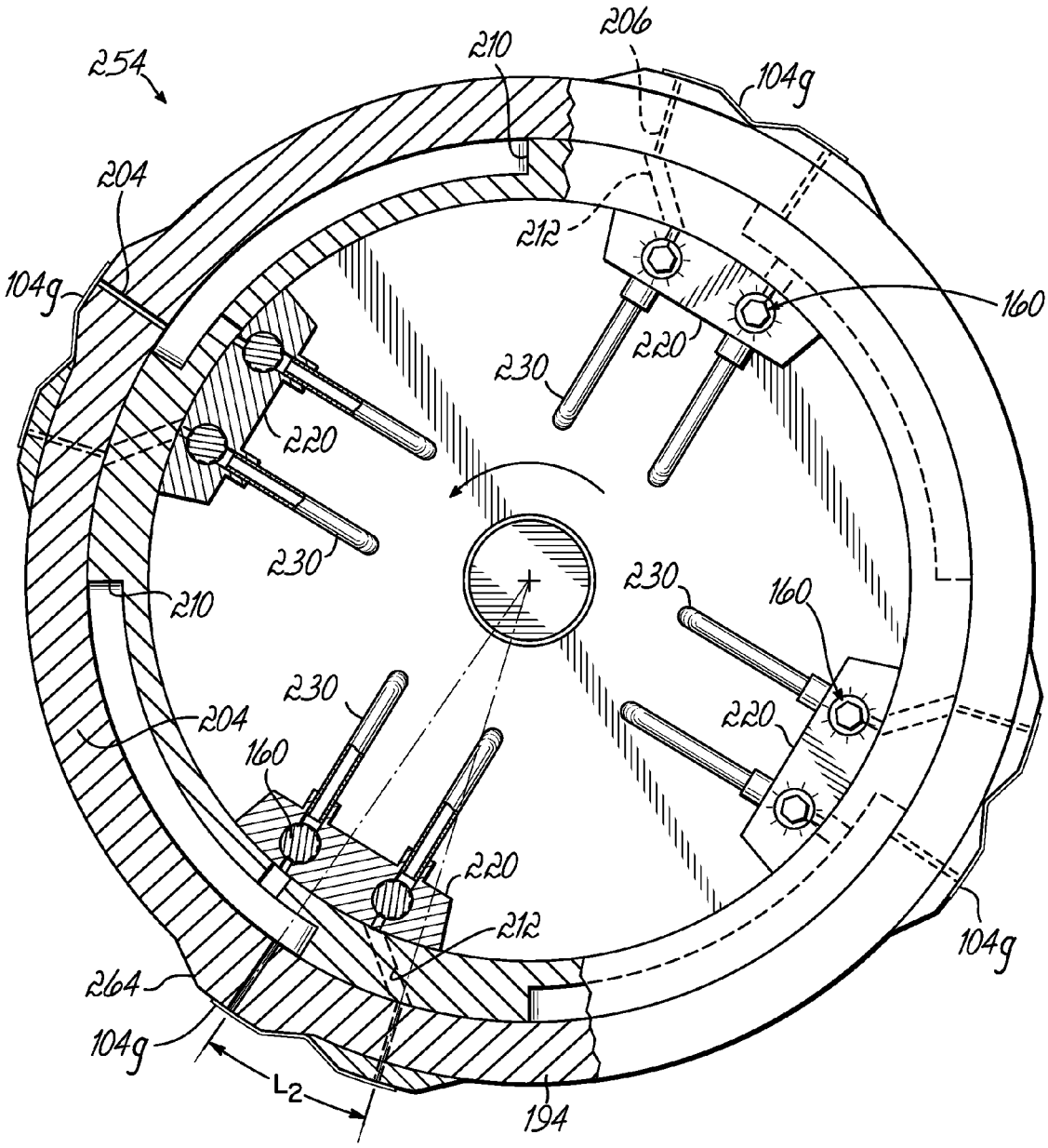
FIG. 12B is a top plan view of the vacuum drum assembly of FIG. 11 in a second configuration for accommodating labels of length L2.
Figure 13:
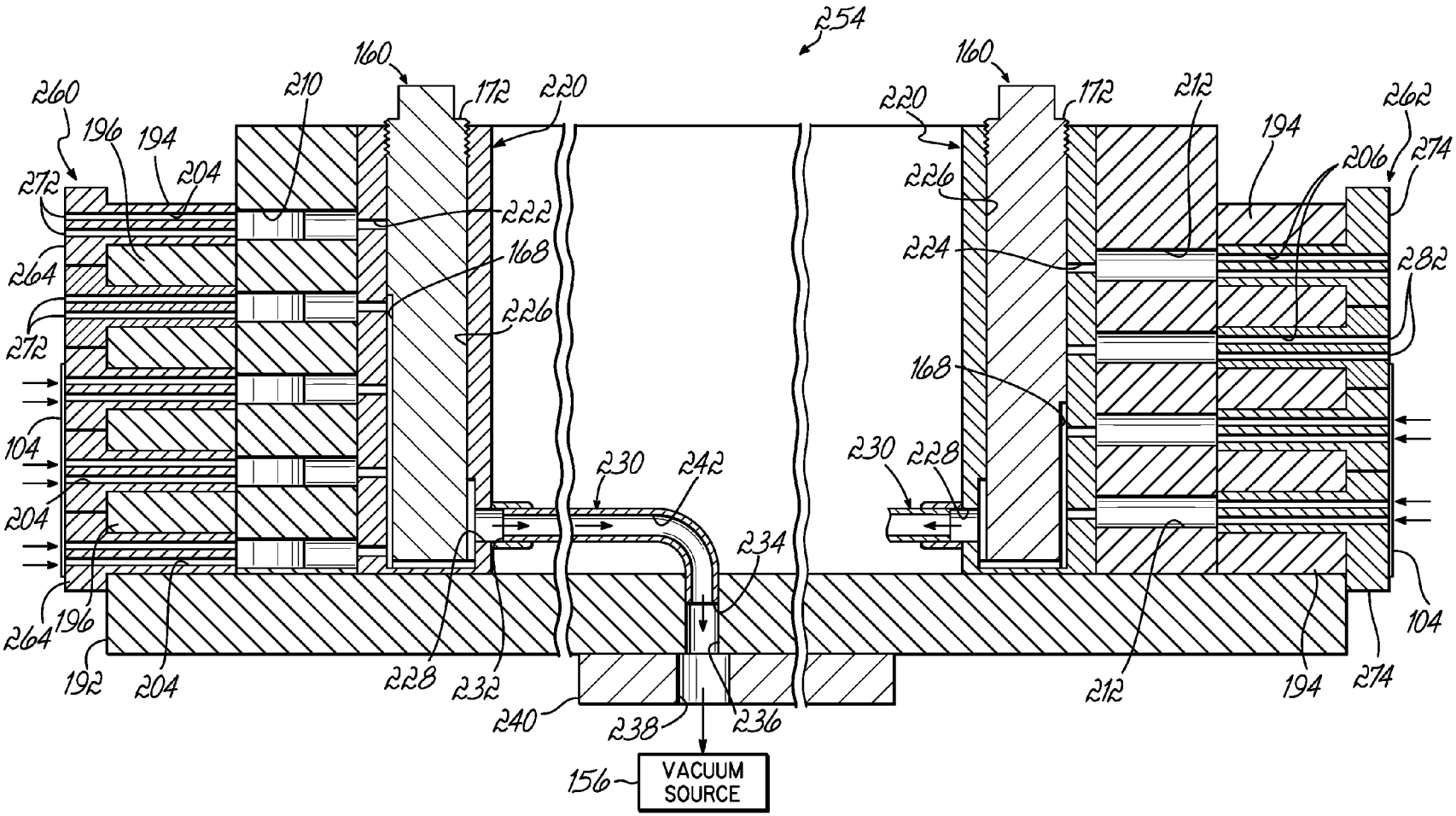
FIG. 13 is a partial cross-sectional view of the vacuum drum assembly of FIG. 12A, taken along line 13-13.

In the embodiment shown, the first lands 260 comprise a plurality of axially aligned first segments 264 extending radially outwardly from the first rings 194. Each first segment 264 includes a generally planar outer surface 266 oriented in a direction that is generally tangent to the outer circumference of the first rings 194, and first and second sloped side surfaces 268, 270 extending between the outer surface 266 and the outer circumference of the first rings 194. A plurality of first apertures 272 is provided on the outer surfaces 266 of the first segments 264 and each first aperture 272 communicates with one of a plurality of first radially extending passages 204 through first rings 194. Each first passage 204 through the first rings 194 is in communication with one of a plurality of first passageways 210 through the drum body 182. In the embodiment shown, the first passageways 210 comprise elongate slots extending generally circumferentially around the drum body 182, as shown in FIGS. 12A, 12B.

Similarly, the second lands 262 comprise a plurality of axially aligned second segments 274 extending radially outwardly from the second rings 196. Each second segment 274 includes a generally planar outer surface 276 oriented in a direction generally tangential to the outer circumference of the second rings 196, and first and second side surfaces 278, 280 extending between the outer surface 276 and the outer circumference of the second rings 196.

A plurality of second apertures 282 is provided on the outer surfaces 276 of the second segments 274. Each second aperture 282 communicates with one of a plurality of second radially extending passages 206 through the second rings 196. The second passages 206 are in fluid communication with corresponding second passageways 212 extending through the drum body 182, as described above.

The vacuum drum assembly 254 further includes a plurality of vacuum housings 220 coupled to the inner peripheral surface 190 of the drum body 182 at locations corresponding to the locations of the first and second passageways 210, 212 through the drum body 182. Each vacuum housing 220 includes axial bores 226 that are in fluid communication with the first and second passageways 210, 212 in the drum body 182 through corresponding first and second ports 222, 224 through the vacuum housings 220, in a manner similar to that described above for vacuum drum assembly 180.

Air distributors 160 are disposed within each of the bores 226 and are adjustable to align a recess 168 formed in an outer surface 164 of the distributor body 162 with one or more of the first or second ports 222, 224 in the vacuum housings 220. The bores 226 are configured to provide fluid communication between the first and second ports 222, 224 and the outlets 228 in the vacuum housings 220 through the recess 168.

The vacuum drum assembly 254 further includes vacuum conduits 230 having first ends 232 coupled to the outlets 228 of the vacuum housings 220 and second ends 234 coupled to axially extending bores 236 through base plate 192 of the vacuum drum assembly 254. The bores 236 through the base plate 192 communicate with corresponding bores 238 through a vacuum plate 240 coupled to the base plate 192. Bores 238 are in fluid communication with a vacuum source 156. Accordingly, vacuum pressure is developed at the first and second apertures 272, 282 on the respective first and second lands 260, 262 by fluid communication through the first and second passages 204, 206 of the first and second rings 194, 196, through the first and second passageways 210, 212 of the drum body 182, through the first and second ports 222, 224 of the vacuum housings 220, through outlets 228, through fluid passages 242 of vacuum conduits 230, and through bores 236, 238 of base plate 192 and vacuum plate 240, respectively.

In use, labels 104 may be supported on the vacuum drum assembly 254 with leading edges of the labels 104 proximate the second apertures 282 on the second lands 262, and with the trailing edges of the labels 104 positioned proximate the first apertures 272 on the first lands 260, whereby vacuum pressure provided to the first and second apertures 272, 282 retains the labels 104 on the vacuum drum assembly 254. Because the first rings 194 are rotatably adjustable about the outer peripheral surface 188 of the vacuum drum body 182, the circumferential positions of the first apertures 272 may be adjusted relative to the second apertures 282 so that labels 104 of various lengths may be accommodated by the vacuum drum assembly 254, in a manner similar to that described above with respect to vacuum drum assembly 180.

For example, FIG. 12A depicts vacuum drum assembly 254 with first rings 194 in a first position suitable for supporting labels 104*f* of length L1 on the vacuum drum assembly 254. FIG. 12B depicts vacuum drum assembly 254 with first rings 194 in a second position suitable for supporting labels 104*g* of length L2 on the vacuum drum assembly 254, wherein L2 is less than L1. While first rings 194 are adjustable to accommodate various label lengths, the air distributors 160 are adjustable to accommodate various label widths, as described above.

The exemplary vacuum drum assemblies 102, 180, 254 described above are able to accommodate labels of varying lengths and/or widths, either on a single drum body, or with fewer drum bodies than was possible with conventional vacuum drum assemblies. Adjustment of the exemplary vacuum drum assemblies, via the air distributors and rotatable rings is much simpler and less time consuming than conventional vacuum drum assemblies having dedicated label support pads. Moreover, vacuum drum assemblies having uniform outer surfaces, such as those depicted in FIGS. 1-3 and 7-10, are more cost effective and easier to manufacture and maintain than conventional drum bodies having raised lands or dedicated pads for accommodating the leading and trailing edges of labels.

While the present invention has been illustrated by the description of one or more embodiments thereof, and while the embodiments have been described in considerable detail, they are not intended to restrict or in any way limit the scope of the appended claims to such detail. The various features described herein may be utilized alone or in any combination. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A vacuum drum assembly for applying labels to objects, comprising:

a generally cylindrical drum body having an outer peripheral surface and an inner peripheral surface;

a plurality of apertures in an outer circumferential surface of the vacuum drum assembly, said apertures defining locations on said outer circumferential surface for supporting labels thereon;

a plurality of passages in said drum body, between said inner peripheral surface and said outer peripheral surface, at fixed circumferential locations thereon, said passages adapted to communicate with a vacuum source;

each said aperture in fluid communication with one of said passages such that vacuum pressure may be developed at said apertures through said respective passages;

the vacuum drum assembly being adjustable to vary at least one of an axial configuration or a circumferential configuration of said plurality of apertures in fluid communication with the vacuum source, such that the vacuum drum assembly is adapted to support differently sized labels on said outer circumferential surface; and at least one first ring received over said outer peripheral surface of said drum body and defining at least a portion of said outer circumferential surface of the vacuum drum assembly;

wherein said plurality of passages in said drum body comprises a plurality of first passages; and wherein said plurality of apertures comprises a plurality of first apertures in said first ring, each said first aperture communicating with one of said first passages;

said first ring being rotatable around said outer peripheral surface of said drum body while said first apertures are in communication with said first passages to thereby adjust the circumferential locations of said first apertures relative to said drum body.

2. The vacuum drum assembly of claim 1, further comprising:

at least one second ring received over said outer peripheral surface of said drum body and defining at least a portion of said outer circumferential surface of the vacuum drum assembly; and wherein said plurality of passages in said drum body further comprises a plurality of second passages;

wherein said plurality of apertures further comprises a plurality of second apertures in said second ring, each said second aperture communicating with one of said second passages;

whereby rotation of said first ring adjusts the circumferential locations of said first apertures relative to said second apertures to accommodate a desired length of label.

3. The vacuum drum assembly of claim 2, wherein:

at least one of said first passages or said second passages are arranged in a plurality of respective, generally axially aligned rows, said rows spaced in a circumferential direction around said drum body.

4. The vacuum drum assembly of claim 3, further comprising:

a plurality of bores through said drum body, extending from said first axial end toward said second axial end, each said bore adapted to be in fluid communication with the vacuum source;

each of said first passages communicating with one of said bores, and each of said second passages communicating with another one of said bores for fluid communication with the vacuum source; and an air distributor disposed in each bore, each said air distributor adjustable to selectively provide fluid communication through said bore and between one or more of said first passages or said second passages in said respectively associated row and the vacuum source.

5. The vacuum drum assembly of claim 4, wherein each said air distributor comprises:

an elongate, cylindrical distributor body, said distributor body having an outer circumferential surface; and at least one recess formed into said outer circumferential surface of said distributor body, said recess configured to provide fluid communication between one or more of said apertures in said associated row of apertures as said distributor body is rotated within said bore.

6. The vacuum drum assembly of claim 5, wherein said recess comprises plural slots formed into said outer circumferential surface and extending axially along said distributor body.

7. The vacuum drum assembly of claim 2, further comprising:

raised lands on said first and second rings and in registration with said first and second apertures.

8. The vacuum drum assembly of claim 2, further comprising:

raised lands on said first and second rings and in registration with said first and second apertures.

9. The vacuum drum assembly of claim 7, wherein said raised lands correspond to positions on the vacuum drum assembly for receiving the leading and trailing edges of a label, respectively.

10. A vacuum drum assembly for applying labels to objects, comprising:

a drum body having an outer peripheral surface;

a plurality of apertures in said outer peripheral surface and defining locations on said outer peripheral surface for supporting labels thereon; and a plurality of passages in said drum body, said passages adapted to communicate with a vacuum source;

each said aperture in fluid communication with one of said passages such that vacuum pressure may be developed at said apertures through said respective passages;

the vacuum drum assembly being adjustable to vary at least one of an axial configuration or a circumferential configuration of said plurality of apertures in fluid communication with the vacuum source, such that the vacuum drum assembly is adapted to support differently sized labels on said outer peripheral surface;

wherein said drum body has a first axial end and a second axial end, and wherein said plurality of apertures are arranged in a plurality of generally axially aligned rows, said rows spaced around said outer peripheral surface, the vacuum drum assembly further comprising:

a plurality of bores through said drum body extending from said first axial end toward said second axial end, each said bore associated with one of said axially aligned rows of apertures and adapted to be in fluid communication with the vacuum source, and an air distributor disposed in each bore, each said air distributor adjustable to selectively provide fluid communication between one or more of said apertures in said associated row of apertures and the vacuum source through said bore;

wherein each said air distributor comprises:

an elongate, cylindrical distributor body, said distributor body having an outer circumferential surface, and at least one recess formed into said outer circumferential surface of said distributor body, said recess configured to provide fluid communication between one or more of said apertures in said associated row of apertures as said distributor body is rotated within said bore; and wherein said recess comprises plural, spaced-apart slots formed into said outer circumferential surface and extending axially along said distributor body.

* * * * *

UNITED STATES PATENT AND TRADEMARK OFFICE

CERTIFICATE OF CORRECTION

PATENT NO. : 8,245,752 B2
APPLICATION NO. : 12/402812
DATED : August 21, 2012
INVENTOR(S) : Eric Lingier et al.

Figure 11:
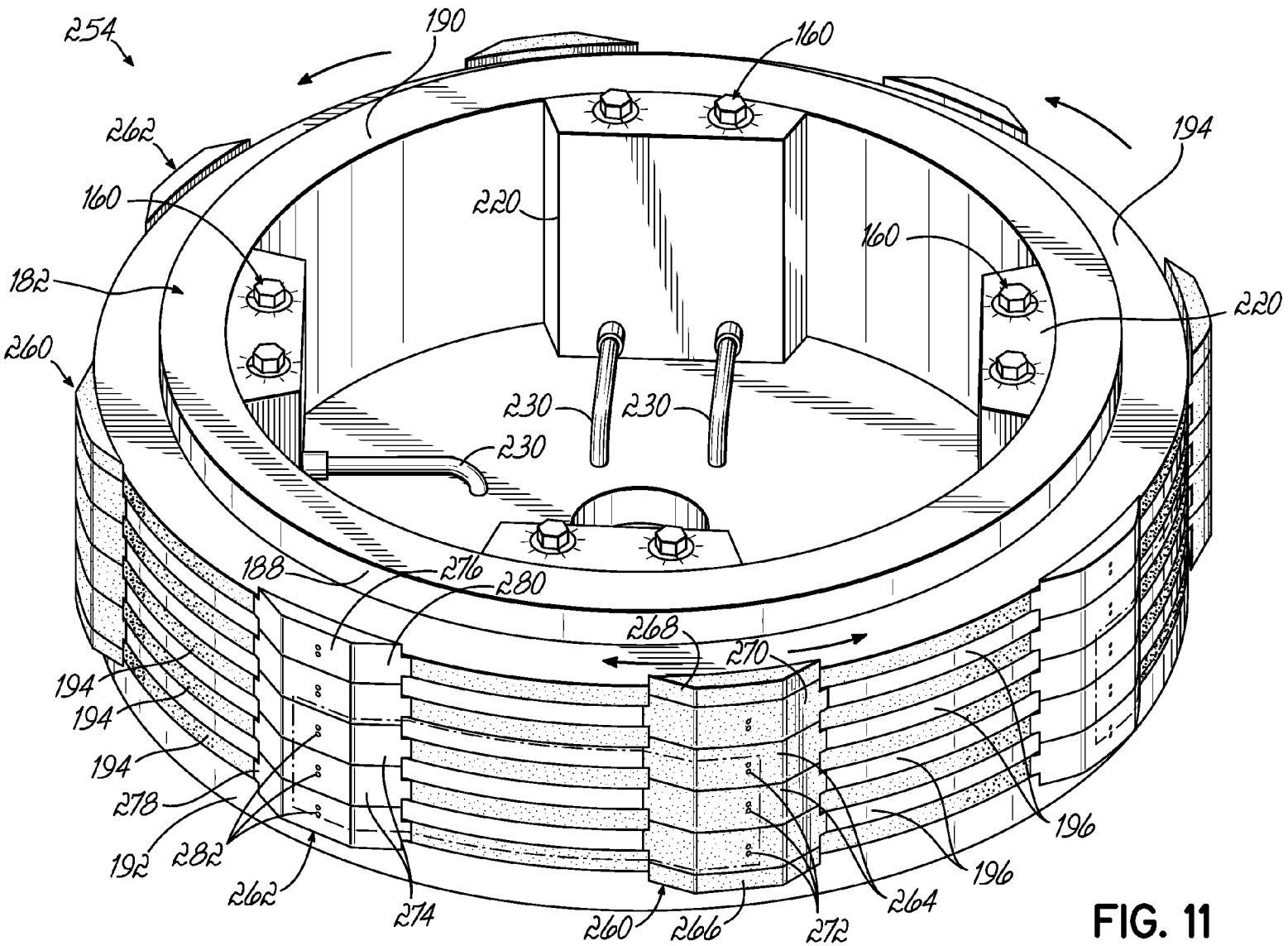
FIG. 11 a perspective view of an exemplary vacuum drum assembly for use with the labeling apparatus of FIG. 10.

It is certified that error appears in the above-identified patent and that said Letters Patent is hereby corrected as shown below:

In the Specifications:

Column 3, line 37 reads "FIG. 11 a perspective view of" and should read -- FIG. 11 is a perspective view of --

Column 5, line 40 reads "such a hex head or other" and should read -- such as a hex head or other. --

In the Claims:

Column 11, lines 20-21, Claim 3 reads "at least one of said ... are arranged in a" and should read -- at least one of said ... is arranged in a --

Signed and Sealed this
Fifth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,245,752 B2
APPLICATION NO. : 12/402812
DATED : August 21, 2012
INVENTOR(S) : Eric Lingier et al.

It is certified that error appears in the above-identified patent and that said Letters Patent is hereby corrected as shown below:

IN THE CLAIMS:

At Column 12, Line 1, Claim 8 reads "The vacuum drum assembly of claim 2, further comprising: raised lands on said first and second rings and in registration with said first and second apertures." and should read -- The vacuum drum assembly of claim 7, wherein said raised lands correspond to positions on the vacuum drum assembly for receiving the leading and trailing edges of a label, respectively. --

At Column 12, Line 5, Claim 9 reads "The vacuum drum assembly of claim 7, wherein said raised lands correspond to positions on the vacuum drum assembly for receiving the leading and trailing edges of a label, respectively" and should read -- The vacuum drum assembly of claim 1, further comprising: an adhesive dispenser proximate said drum body and adapted to dispense adhesive to a label supported on said outer peripheral surface. --

Signed and Sealed this
Second Day of April, 2013

Teresa Stanek Rea
*Acting Director of the United States Patent and Trademark Office*